US006675895B1

(12) United States Patent
Shehab et al.

(10) Patent No.: US 6,675,895 B1
(45) Date of Patent: Jan. 13, 2004

(54) WELL CEMENTING

(75) Inventors: Gamal Shehab, Gretna, LA (US); John F. Vaeth, Slidell, LA (US); Lucian K. Johnston, Mandeville, LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/209,698

(22) Filed: Jul. 31, 2002

(51) Int. Cl.[7] ..... E21B 33/13
(52) U.S. Cl. ..... 166/292; 166/250.14
(58) Field of Search ..... 166/281, 285, 166/293, 250.14, 64, 292

(56) References Cited

U.S. PATENT DOCUMENTS 4,036,301 A * 7/1977 Powers et al. ..... 166/293
4,054,461 A * 10/1977 Martin ..... 106/717
4,054,462 A * 10/1977 Stude ..... 106/717
4,210,455 A * 7/1980 Metcalf et al. ..... 106/727
5,095,987 A * 3/1992 Weaver et al. ..... 166/276

OTHER PUBLICATIONS

*Cement Sheath Evaluation*–API Technical Report 10TR1, First Edition, Jun. 1996.

* cited by examiner

*Primary Examiner*—Frank Tsay
(74) *Attorney, Agent, or Firm*—Catherine Menes; Robin Nava; Brigitte Jeffery

(57) ABSTRACT

The combination of the cement contamination laboratory measurements and the field log measurement allows to perform the evaluation of cement placement and quality related to the designed percentage cement displacement coverage and set-up times in the casing annulus. Since the logging time after the cement job is completed is known, a comparison between the acoustic impedance or compressive strength measured using the USI log and the acoustic impedance or the compressive strength measured in the laboratory, a level of mud contamination can be derived at every point across the wellbore. From the laboratory correlations, cement strength prediction with time can be established. This new product will give the operator an accurate tool to recommend performing remedial cementing with a higher success rate.

8 Claims, 2 Drawing Sheets

WELL CEMENTING

FIELD OF THE INVENTION

The present invention relates to well cementing design and evaluation methods and more particularly, proposes a combination of formation evaluation, cement design, cement laboratory experiments and cased hole evaluation for better cementing of casings in subterranean wells.

BACKGROUND OF THE INVENTION

After drilling a well, such as an oil or gas well, the drill pipe is removed and a string of casing is lowered into the wellbore. At this time the drilling mud used to compensate the formation pressure and to remove the formation cuttings from the well is still in the wellbore. In the annulus between the well wall and the casing, this mud needs to be replaced by a cement sheath that holds the casing in place, stabilizes and protects the casing, and to the uppermost point, provides zonal isolation.

Poor zonal isolation results in fluid migrations e.g. water or gas may invade an oil-bearing zone, resulting eventually in a risk of blow out, or to less severe but economically challenging problem such as water production (and the need to provide expensive water treatment surface facilities) or loss of reserves and productions. Remedial work to repair a faulty cementing job is expensive (inasmuch as it increases rig time and delays oil or gas production) and sometime leads to irreparable harm to the hydrocarbon-bearing production.

Evaluating a primary cementing job and eventually electing to perform a remedial treatment is one of the most critical decisions made by the operator during the completion phase of the hydrocarbon wells. Unfortunately, this area is still very ambiguous due to the fact that there is no consistent method or process to address cement evaluation in a systematic manner taking into account the different factors that can affect his primary cement job. Moreover, in response to a demand for cements suitable for deeper, hotter or cooler wells, deviated or horizontal wells, new types of cements and additives have been introduced recently, whose evaluation result in new challenges.

In most cases, poor zonal isolation results from poor mud removal. As mentioned before, the well is initially filled with mud. The cement is placed by pumping a cement slurry downhole trough the casing and back up into the annulus between the casing and the borehole so that the mud is displaced to the surface. In theory, the casing is a perfect cylinder centered inside another perfect cylinder, the well and the cement displaces the mud as in two communicating vases. In the real world, neither the casing nor for the well is cylindrical.

Hydraulic cements set and develop compressive strength as a result of hydration of different cement phases. Although this is a continuous process, three main phases can arbitrarily be defined. In the first phase, the cement slurry has a relatively low viscosity and essentially constant rheological properties. This first phase corresponds to the pumping and placement of the cement downhole. In the second phase, the consistency of the cement increases so that it becomes difficult to pump and place it correctly. However, the developed compressive strength is not enough for the cement to be self-supported and to withstand a significant strength. In the third and last phase, the cement continues to develop compressive strength but the well security is insured and the well construction may be resumed.

During this third phase, the cement is evaluated and a remedial cementing operation may be recommended if the compressive strength is below the expected level. The remedial cementing operation typically consists in isolating the area where the cement evaluation logs revealed low cement compressive strength, perforating the casing and injecting a cement slurry under pressure, a process known as squeeze cementing. Unfortunately, it is often the case that a remedial operation cannot be successfully completed. In many cases the cement cannot be squeezed in the annulus between the casing and the wellbore resulting in fracturing the formation and pumping the cement into the wrong place. Often, this is due to the difficult of interpreting ambiguous results provided by the evaluation tolls.

Moreover, even if this operation is a success, it certainly delays the completion of the well and the beginning of the well production, resulting in significant profit losses for the operator.

It would be suitable to improve the methods of designing and evaluating primary cementing operation to reduce the need for remedial cementing, or improves the efficiency of remedial operations when required.

SUMMARY OF THE INVENTION

This invention provides a scientific and systematic method for cement design, job execution and evaluation taking into account wellbore geometry, cement and mud properties, cement job design and execution and evaluation. It also provides a new way to predict cement strength with time.

According to the invention, a significant improvement in cement evaluation is attained by employing a procedure that involves identifying a contaminant, designing a cement slurry, obtaining a set of data related to the development of the compressive strength versus time for said cement slurry at different levels of contamination, pumping the designed cement slurry, evaluating the curing properties of the pumped cement after the cement placement, assessing the degree of contamination of the slurry based on the set of data and predicting the long-term real compressive strength of the contaminated cement.

In one embodiment of the present invention, the step of obtaining a set of data related to the development of the compressive strength versus time for said cement slurry at different levels of contamination includes obtaining correlation curves for each contaminant, showing the linear relationship between contaminated cement compressive strength at different levels of contamination relative to a non-contaminated slurry compressive strength.

Otherwise stated, the cement evaluation log performed after the cementing operation is a 'snap shot in time' used to predict the final quality of the cement rather than the final result on the job. As a result, accurate recommendations can be made on the opportunity of making a remedial cementing.

In most cases, the invention is carried out by a combination of formation evaluation, cement design, cement laboratory experiments and cased hole evaluation for better cementing of casings in particular for oil and gas wells.

BRIEF DESCRIPTION OF THE DRAWINGS

Further objects and advantages of the invention will become apparent from the further description, made in reference to the drawings wherein.

DETAILED DESCRIPTION AND PREFERRED EMBODIMENTS

Figure 1:
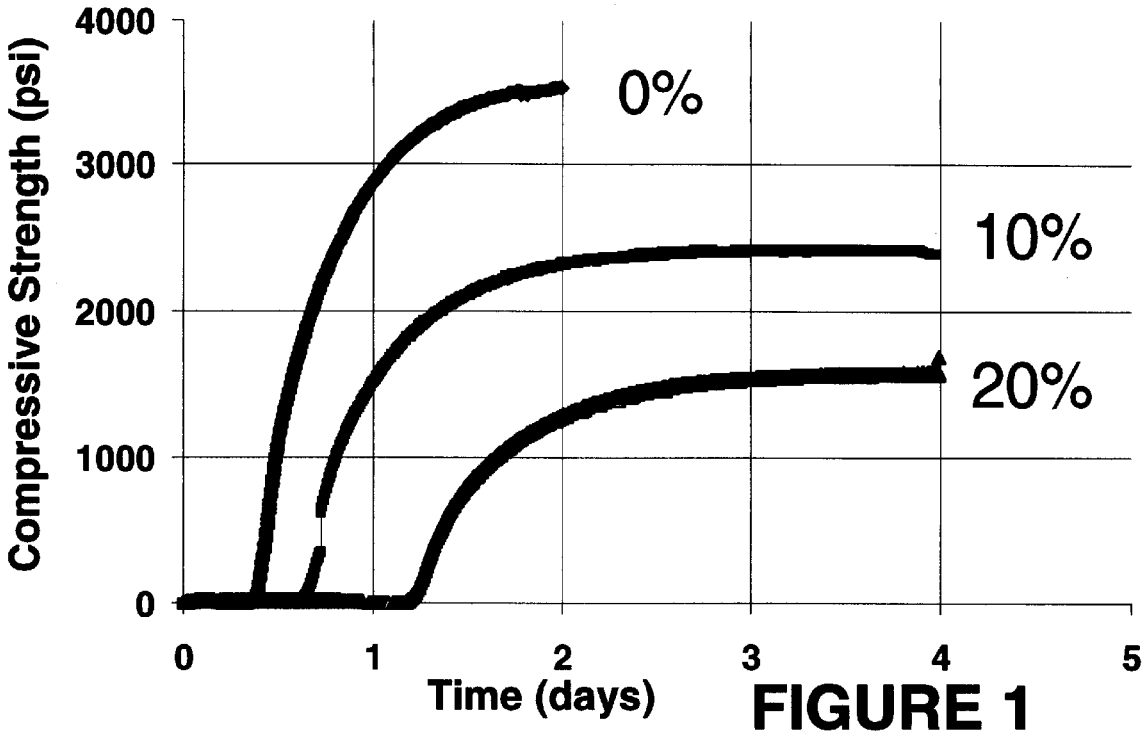
FIG. 1 shows the time effects on cement curing time due to contamination by a water-based mud.

In the interest of clarity, this invention will be further explained by referring to the most common contaminant of well cement, the drilling mud. However, it is well known by those skilled in the art that cement contamination may also result for instance from the spacing fluid pumped ahead of the cement slurry, for instance when the cement slurry is not compatible with the drilling mud. More generally, the cement may be contaminated by any fluid previously pumped downhole or even any formation fluid. In any case, once a potential contaminant, or a mixture of various contaminants, has been identified, the process will be identical. It will of course be appreciated that where several contaminants are considered, the actual implementation may be complex and time-consuming, but would nevertheless be a routine undertaking for those of ordinary skill in the art having the benefit of this disclosure.

It should be further emphasized that the term "casing" as employed in this disclosure, is meant to encompass all casing strings used to complete a well, and includes for instance the conductor pipe, the surface casing, the production casing, and liners, i.e. a string of casing which does not extend all the way to the surface but is hung from inside the previous casing string.

The first step generally includes testing in laboratory to estimate the effects of mud contamination on the cement strength. The second step is a time-based evaluation of the cement after placement.

Mud Contamination

According to a first aspect of the present invention, prior to cementing a well a sample of the proposed cement and the potential contaminant (the drilling mud) are tested in the cement laboratory for the effects of contamination on the cement strength. Of course, the collected data may be archived, preferably in a computerized database, for further use.

The testing is carried out following lab-standardized experiments and correlations for mud contaminated cements of controlled incremental densities at bottom hole pressure and temperature conditions. The evaluation is preferably based using a tool that offers a direct correlation with field data acquired from logging tools. For instance, both laboratory data and field data can be based using devises measuring the acoustic impedance Z of the cement, measured in Mega Rayle (or $10^6$ Kg/m$^2$sec). The Mega Rayle is the product of the density of the medium (liquid mud, cement or a contaminated mixture) times the 'ultrasonic' velocity through this medium.

The Ultrasonic Cement Analyser or UCA is a standard API (American Petroleum Institute) laboratory device used to evaluate cement by measuring the acoustic impedance 'Z' directly in Mega Rayles. Present "state of the art" interpretation techniques compare the likely contaminated field cement with a non-contaminated cement prepared in the clean environment of a laboratory.

In practice, the interpretation charts for cement sheath evaluation tools considered 24-hour UCA cement values for a nominal 3000 psi compressive strength for a standard 'Class H' cement slurry as a standard for 100% good bond. However, the real issue is hydraulic isolation between the primary productive zone and the other formations. This does not necessarily rely on complete cement fill of the casing/borehole annulus with 3000 psi cement after 24 hours or 100% cement in place. Moreover, any cement that has set up in excess of 500 psi cannot normally be improved upon by remedial cement squeeze work. Consequently, many squeeze jobs are recommended and considered unsuccessful because liquid squeeze cement could not be pumped into the 'log indicated' poor bond area of the casing open hole annulus without approaching or surpassing fracture gradient pressures.

The laboratory experiments study and modeled family of correlation curves offer a quantifiable solution of not only percent contamination of the cement, but more importantly, another measurable tool for the interpreter to base the success of pumping a squeeze job. From this laboratory experiments, a family of correlation curves are established that offers quantifiable compressive strengths and Z from solid 'set' cement to contaminated liquid measured in 'time to set up'. The UCA data correspond to the field measurements in such a way that mud channels and weak cement areas will now both be visually identified on the log (as they are today) and quantified as movable/pumpable with a cement squeeze operation. With quantifiable field data, improper squeeze recommendations can be eliminated.

Correlations for Time Effects on Cement Strength due to Mud Contamination

Sonic well logging tools have been utilized for years to determine cement conditions within cased wellbores. An overall description of the different types of tools can be found in the API Technical Report 10TR1, June 1986, entitled "Cement Sheath Evaluation".

The first generation is illustrated by the Cement Bond Logging tool or CBL that emits omni-directional series of acoustic energy pulse at a frequency of about 20K Hz. The sound wave travels through the casing and the cement into the formation and the reflected sonic signal or echo is received using a sonic transducer. Where the casing is cemented, there is a complete acoustic coupling between the casing and the formation and therefore, the cement prevents the casing resonance. Where channeling exists at the casing-cement interface, a casing signal is detected. The CBL tools are run at a pre-determined 'minimum cement set-up time' (often based on a 500 psi compressive strength cutoff from lab data) after pumping is completed, based on a 100% cement slurry displacement of the mud in the casing annulus to a desired cement top (height in the well annulus).

Along the years, innovations have lead to the advent of improved tools including for instance compensated logging tools that measure the signal attenuation rate, such as the Segmented Bond Tool or SBT (mark of Western Atlas International Inc). Ultrasonic tools, operating usually in the range of 190 KHz to 750 KHz, have been developed in the 90s, such as the Pulse Echo Tool (or P.E.T., mark of Halliburton Energy Services) or the Cement Evaluation Tool (or C.E.T, mark of Schlumberger). Examples of the most recent tools include the UltraSonic Imager Tool or USI tool (mark of Schlumberger) that scans the entire wellbore circumference and comprises a single rotating sensor emitting ultrasonic pulses and measures the resulting resonance and the Cement Bond Tool or CBT (mark of Schlumberger) that provides a precise axial measurement of cement-to-casing and cement-to-formation bond using high-frequency sound pulses in the 20 KHz range.

Those tools can accurately define discrete circumferal 'contamination' channels in casing cement annulus. These channels could be formed by the improper annular sweep of drilling mud, formation water, gas or oil invading the slurry as the cement was pumped up the annulus. Both the CBT and USI quantitatively measure the casing cement interface, however, as explained below, one tool is more appropriate to provide information as to the quality of the cement-to-casing interface, and the other as to the cement-to-formation interface.

This is accomplished by the CBT using the 3-foot transmitter to receiver spacing and is recorded in millivolts, then converted to decibels of signal attenuation. This same casing cement interphase is measured by the USI tool and recorded quantitatively in units of Mega Rayles, which are units of 'Acoustic Impedance'. Both decibels of attenuation (in received signal from the CBT) and Mega Rayles of Acoustic Impedance (from the USI) are directly related to the 'compressive strength' of the cement at the casing cement interphase at that exact time when the survey is made. The CBT amplitude measurement 'sees' the same casing cement interface as an average attenuation at depth (average measurement due to omni-directional pulse), the USI discretely measures and quantifies the cement in terms of acoustic impedance on a casing 'length of arc' of 1.2 inches. The CBT device's 5-foot transmitter to receiver spacing provides an "image" of the cement to formation interface if the cement has adhered to the formation at the borehole wall by way of the VDL (Variable Denisty Log) or WF (Wave Form) presentation of the 'Formation's' first arrival time. When both types and depths of measurement of the CBT and the USI work in concert, a complete cement evaluation is achievable in terms of contaminated slurry or liquid channel identification in terms of quantitative as well as qualitative cement interphase evaluation. In other words, the combination of the two measurements makes it possible to discriminate between a contaminated cement that provides only 60% of the expected compressive strength—but that won't be a candidate for squeeze cementing—and a perfect cement sheath that covers only 60% of the area, leaving 40% uncemented.

Rather than comparing the field data with "perfect" cement, the invention proposes to compare them with lab-contaminated data to evaluate the degree of contamination of the cement.

The basis of 'time based cement evaluation logging' is predicated on the mud contamination cement study, whereby the set time of cement is either retarded (as in lignosulfonate water-based muds) or accelerated (as in synthetic oil muds due to the NaCl concentrations) based on the mud type and percent contamination. The laboratory defined, time dependent correlations for cement set times offers a corrected cement set time after the first log is run, based on the actual percent contamination vs. time since the plug was pumped.

The basis of 'time based cement evaluation logging' is predicated on the Schlumberger OFS mud contamination cement study, whereby the set time of cement is either retarded (as in lingosulfonate WBM muds) or accelerated (as in Nova+ synthetic oil muds due to the NaCl concentrations) based on the mud type and percent contamination. In the case of standard WBM (water based muds—the lingosulfonate types), any percent contamination prolongs or extends the engineered cement set times (lingosulfonate act as a retarder on standard class 'H' cements).

The time dependent approach to mud contaminated cement evaluation offers a 'new time for cement to set up' from the correlation built during the contaminated cement study at the Cement Laboratory. These Laboratory defined, time dependent correlations for cement set times offers a corrected cement set time after the first log is run, based on the actual percent contamination vs. time since the plug was pumped.

Since the logging time after the cement job is known in hours, a comparison between the acoustic impedance or compressive strength measured using the USI field generated log and the acoustic impedance or the compressive strength measured in the laboratory UCA, a level of mud contamination can be derived at every point across the wellbore. From the laboratory mud contaminated cement correlations, cement strength prediction with time can be established.

The field measured acoustic impedance can converted to compressive strength and matched to a set of lab specified, controlled data sets based on percent contamination vs. time to set up to 500 psi comp strength (minimum set time) along with a maximum set strength (flat region on curve) along this time line (maximum set time).

Figure 2:
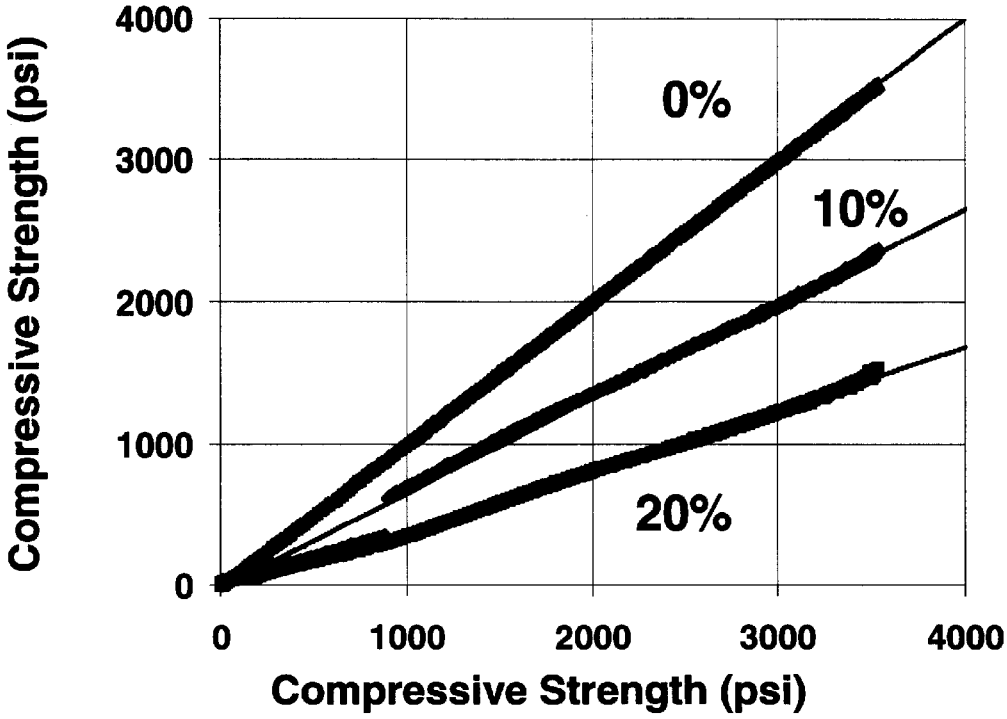
FIG. 2 shows correlation curves providing the compressive strength of a contaminated slurry relative to a non-contaminated slurry, for the different levels of contaminations.
Figure 3:
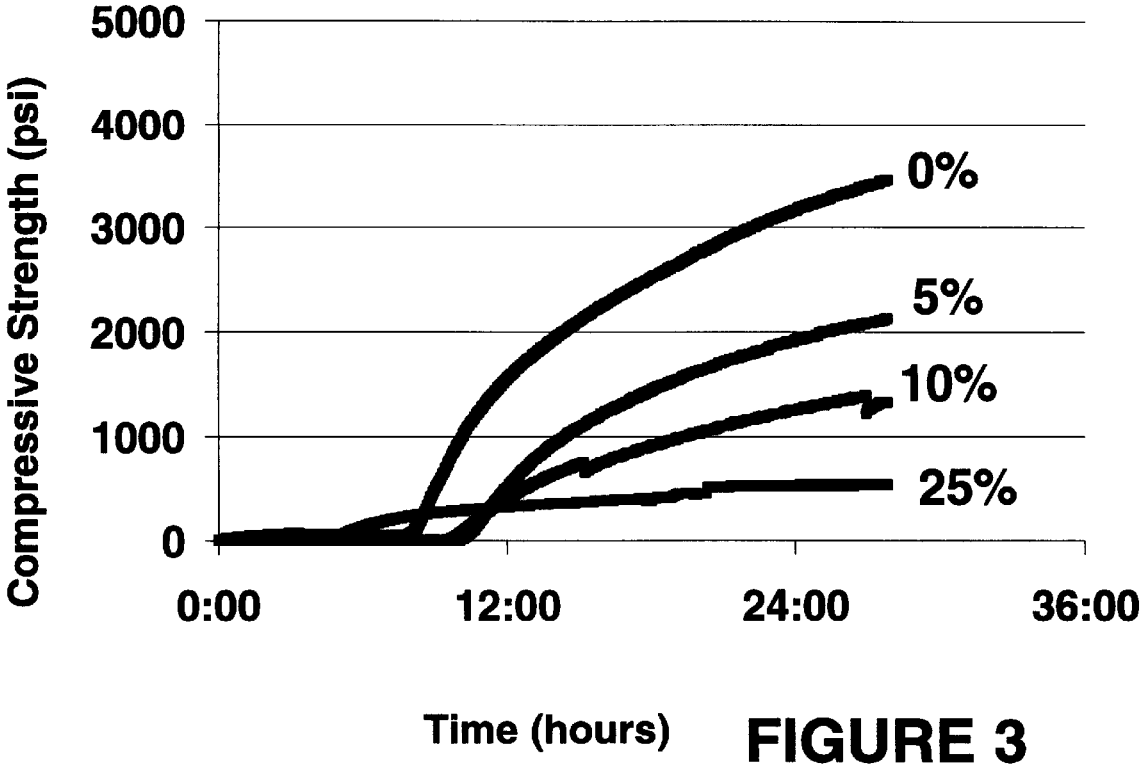
FIG. 3 shows the time effects on cement curing time due to contamination by a synthetic-based mud.
Figure 4:
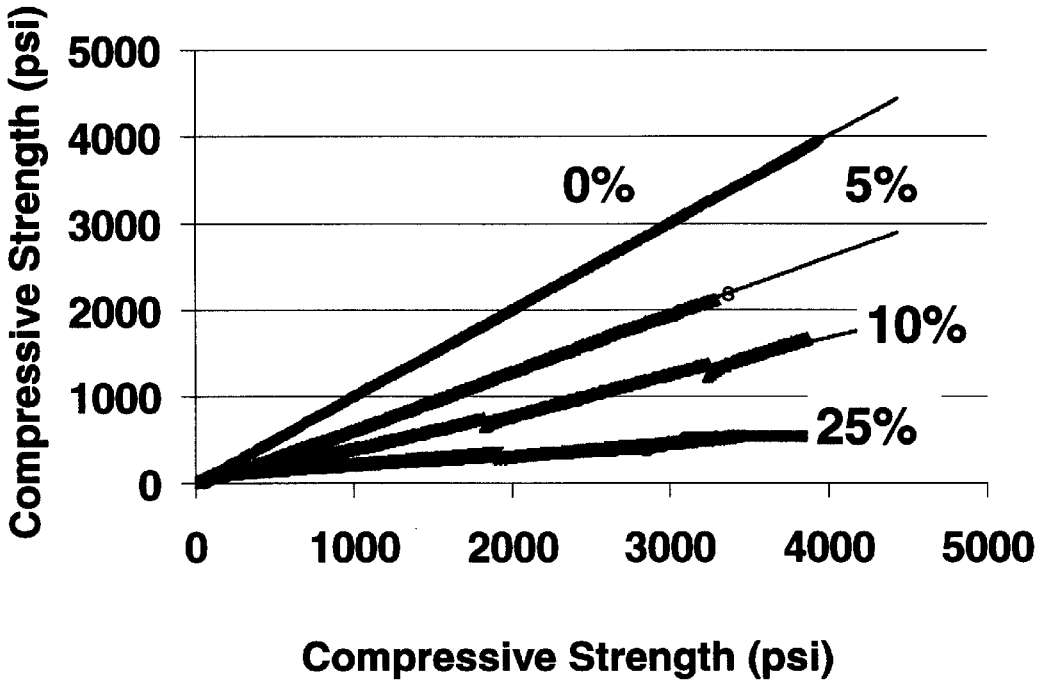
FIG. 4 shows correlation curves providing the compressive strength of a contaminated slurry relative to a non-contaminated slurry, for the different levels of contaminations.

The attached FIGS. 1 to 4 show, as an example, the correlations established for a 16.4 ppg cement slurry prepared with a LeHigh class H cement and contaminated with either a water-based mud (FIGS. 1 and 2) or a synthetic mud (FIGS. 3 and 4). The water base mud has a density of 10 ppg and was prepared by mixing, in the following order, 0.92 bbl (146.26 liters) of water, 15.0 ppb (42.5 kg/m$^3$) of bentonite, 1.0 ppb (2.8 kg/m$^3$) of caustic soda, 4.0 ppb (11.3 kg/m$^3$) of a chrome lignosulfate, 2.0 ppb (5.7 kg/m$^3$) of lignite, 76.96 ppb (218.2 kg/m$^3$) of barite (barium sulfate) and 0.25 ppb (0.7 kgm$^3$), of a viscosifier. The synthetic-base mud has a density of 10 ppg and is a water-in-oil mud with an oil phase consisting of synthetic oil made of internal olefins of mediummolecular-weight.

The mud contaminations used is from 5% up to 25% specified in 5% increments by total volume. FIGS. 1 and 3 show the impact of the mud contamination on the development of the compressive strength.

FIGS. 2 and 4 show that correlations can be established between the compressive strength of a contaminated mud and the compressive strength of the non-contaminated mud. With reference to FIG. 2, a degree of contamination of about 10% can be estimated if the measured compressive strength equals 2000 psi while at the same time, the non-contaminated cement is supposed to exhibit a compressive strength of 3000 psi. To be noted that FIG. 2 is not derived from FIG. 1.

The correlation curves according to the invention are particularly useful for accurate recommendation of a remedial operation. Indeed, the correlation curves may be used for estimating if the compressive strength at the time of the remedial operation is likely to be below or above 400 psi. To be noted that under standard practice, cement was either considered as good or bad. For instance the API Technical Report 10TR1, already cited, states that "For log interpretation and squeeze decision purposes, it is purely academic whether the annular material has 1 psi compressive strength or 5000 psi compressive strength". The inventors have found that indeed, a remedial treatment can be successful as long as the compressive strength is below 400 psi at the time of the remedial treatment.

Using FIGS. 3 and 4, it can be determined that an apparently very poor cement may not be a good candidate for a squeeze remedial operation since the final compressive strength might actually be quite acceptable. On the other hand, apparently good candidates for a remedial cementing operation may be disregarded if the compressive strength is estimated to be higher than about 400 psi when the remedial treatment will be performed. This data has been substantiated by successfully pumping the squeeze cement below fracture pressures, confirmed with 'after squeeze' CBT/USI log data indicating the annular cement fill and verified with the water-free production of these wells.

With a time-base evaluation of the cement, it is further possible to run the logging tools to appreciate the quality of both the cement-to-casing and cement-to-formation interfaces, and estimate the compressive stress provided by the cement well before the non-contaminated cement is supposed to achieve a good compressive strength of about 3000 psi so that the preparation of an eventual remedial job can be initiated earlier than with conventional technology, reducing the wait-on-cement time and increasing the chances of success of such an operation.

According to a preferred embodiment of the present invention, the borehole geometry is measured using calipers and the data are input into a cement design program. The output of the cement design program is usually expressed in a percentage of cement coverage of the annulus between the casing and the wellbore. By adjusting the cement design and the flow regime with respect casing centralization and rheological modifications to the slurry design, the risk of contamination may be minimized.

Once an optimized design has been selected, the cement design program can be used to predict the zones of poor mud displacement and the likelihood of contamination. With that information and the knowledge of the behavior of the contaminated cement, the engineer may eventually decide to opt for another cement, that may result in average to lower compressive strength but will still permit to avoid a remedial operation in the contaminated area. This result may be achieved for instance by using a cement of lower density.

What is claimed is:

1. A method for cementing the annulus between a casing and a borehole which penetrates a subterranean formation, said method comprising Identifying a contaminant;

Designing a cement slurry;

Obtaining a time-base relationship between the compressive strength of a curing contaminated slurry and of a curing non-contaminated cement slurry;

Pumping the designed cement slurry to place a cemented sheath between the annulus and the casing;

Evaluating the curing properties of the pumped cement slurry short after the cement placement;

Assessing the contamination level and;

Predicting the final compressive strength of the contaminated cured cement.

2. The method of claim 1, wherein the step of obtaining a time-base relationship between the compressive strength of contaminated and non-contaminated cement slurries is performed through laboratory experiments.

3. The method of claim 1, further comprising performing a remedial treatment.

4. The method of claim 3, wherein the remedial treatment is performed at a time when the compressive strength of the contaminated cured cement is below 400 psi.

5. The method of claim 1, wherein the time-base relationship and the evaluation of the pumped cement slurry are based on the same physical property.

6. The method of claim 3, wherein said physical property is the travel time of ultrasonic energy.

7. The method of claim 1, wherein the evaluation of the curing properties of the pumped cement is performed by measuring the signal attenuation due to the acoustic impedance of the cement of ultrasonic and high-frequency pulses.

8. The method of claim 1, further comprising obtaining a set of wellbore parameters including the wellbore geometry and the position of the casing and adjusting the cement design to minimize contamination.

* * * * *